United States Patent [19]

Droz et al.

[11] 4,092,822

[45] June 6, 1978

[54] CONTROL DEVICE FOR AN ELECTRONIC WRIST-WATCH

[75] Inventors: Willy Droz, Hauterive; Jean-Luc Béguin, Neuchatel, both of Switzerland

[73] Assignee: Ebauches SA, Neuchatel, Switzerland

[21] Appl. No.: 635,089

[22] Filed: Nov. 25, 1975

[30] Foreign Application Priority Data

Dec. 11, 1974 Switzerland ..... 16373/74

[51] Int. Cl.[2] ..... G04B 27/08

[52] U.S. Cl. ..... 58/23 R; 58/85.5

[58] Field of Search ..... 58/23 R, 85.5, 38, 50 R; 200/61.83; 240/6.43; 207/116, 141, 283, 293, 246; 340/166, 167, 309.4; 328/48, 129

[56] References Cited

U.S. PATENT DOCUMENTS

| | | | |
|---|---|---|---|
| 3,694,672 | 9/1972 | Butak | 307/293 |
| 3,756,013 | 9/1973 | Bergey et al. | 58/38 |
| 3,760,582 | 9/1973 | Thiess et al. | 58/85.5 |
| 3,760,584 | 9/1973 | Dargent | 58/85.5 |
| 3,781,573 | 12/1973 | Weeden, Jr. | 307/293 |
| 3,788,058 | 1/1974 | Idei et al. | 58/50 R |
| 3,852,951 | 12/1974 | Sauthier | 58/23 R |
| 3,866,406 | 2/1975 | Roberts | 58/85.5 |
| 3,901,022 | 8/1975 | Cleusix et al. | 58/85.5 |
| 3,928,959 | 12/1975 | Naito | 58/23 R |
| 3,943,696 | 3/1976 | Portmann et al. | 58/23 R |

*Primary Examiner*—Robert K. Schaefer
*Assistant Examiner*—Vit W. Miska
*Attorney, Agent, or Firm*—Imirie, Smiley & Guay

[57] ABSTRACT

A control device for an electronic wrist-watch including a delay means and a pair of flip-flop circuits. The device is actuated by a push button switch and provides one of two possible output conditions dependent upon the length of time for which the push button is depressed.

11 Claims, 3 Drawing Figures

CONTROL DEVICE FOR AN ELECTRONIC WRIST-WATCH

BACKGROUND OF THE INVENTION

The present invention relates to a control device for electronic watches, comprising a push button.

In order to increase the possibilities offered by the use of a push button to initiate various operations in a watch, the present invention envisages a device where one can obtain two different effects according to whether the actuation of the push button is of short or of long duration.

SUMMARY OF THE INVENTION

The device in accordance with the invention comprises a push button switch for providing a control signal delay means actuated by said control signal, first and second flip-flop circuits controlled by said delay means, inputs of the flip-flops being supplied with said control signal, the device having outputs formed by a Q output of the first flip-flop circuit and a $\overline{Q}$ output of the second flip-flop circuit, a return-to-zero of the device being effected by setting the first flip-flop circuit to zero and setting the second flip-flop circuit to one.

BRIEF DESCRIPTION OF THE DRAWINGS

The present invention will be described further, by way of example, with reference to the accompanying drawings, in which.

DETAILED DESCRIPTION OF THE DRAWINGS

Figure 1:
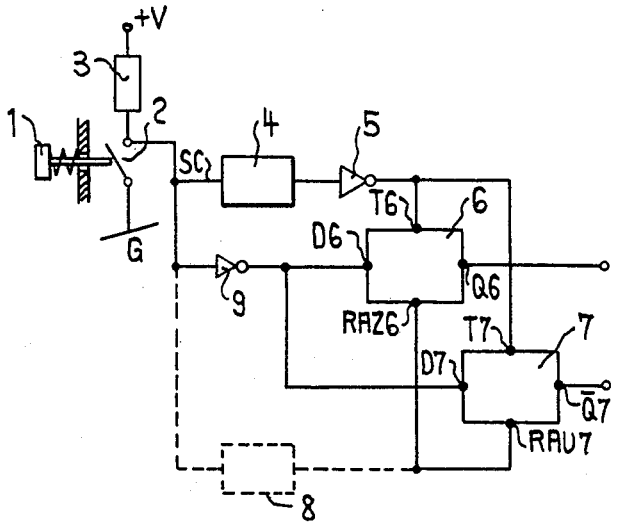
FIG. 1 illustrates an embodiment of a device in accordance with the present invention.

In FIG. 1 a push button 1 actuates a switch 2 which, when it is closed, connects the input of a monostable circuit 4 and the input of an inverter 9 to earth G corresponding to a logic potential "0". When the switch 2 is open, the push button 1 being in the rest position, these inputs are connected to a terminal of voltage +V corresponding to a logic potential "1", via a resistance 3. The output of the inverter 9 is connected to inputs D6 and D7 of two D flip-flops 6 and 7, so that when the switch 2 is open, the inputs D6 and D7 are at the logic potential 0 and when the switch 2 is closed the input D6 and D7 are at the logic potential 1. The monostable circuit 4 has a delay time $\tau$. The output of the monostable circuit 4 is connected via an inverter 5 to the control inputs T6 and T7 of the flip-flops 6 and 7. The outputs of the device are provided, on the one hand, by the output Q6 of the flip-flop 6 and, on the other hand, by the output $\overline{Q}$7 of the flip-flop 7.

Before circuit operation, the device must be placed in adequate initial conditions which correspond to the normal functioning of the watch. In our case, the two outputs Q6 and $\overline{Q}$7 of the device must be set at zero. To do this, the flip-flop 6 will be returned to zero by its input RAZ 6 and the flip-flop 7 returned to one by its input RAU 7 so that its out-put $\overline{Q}$7 is at zero. (For resetting) flip-flops 6 and 7, a timing circuit 8 is provided which may be a monostable circuit.

Figure 2:
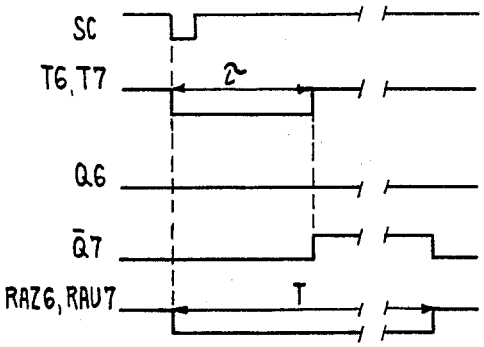
FIGS. 2 and 3 show diagrams illustrating the functioning of the device of FIG. 1.
Figure 3:
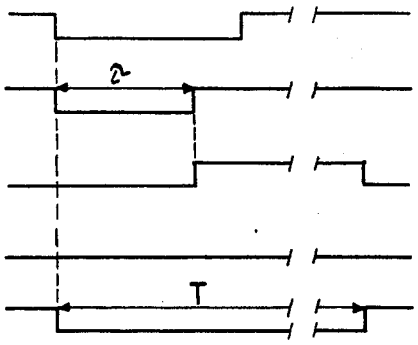

FIGS. 2 and 3 illustrate two cases of actuation of the push button 1. In the first case (FIG. 2), the actuation is short, which provides a control signal SC which is relatively short. In the second case (FIG. 3), the actuation of the push button is long, providing a relatively long signal SC.

The monostable 4 changes state at the beginning of this control signal SC, and after a period $\tau$, the inputs T6 and T7 receive a positive going edge which causes the information present at the input D6 of flip-flop 6 and for the flip-flop circuit 7 the reverse of the information present at the input D7 to be conveyed to the outputs of the device. Thus, for a signal SC of short duration at the instant of transfer of information by the flip-flop circuits 6 and 7, the outputs Q6 and $\overline{Q}$7 will be in the state 0,1 and for a signal SC of long duration the condition will be:

1,0

Thus, there is obtained a coding of output information in accordance with the duration of pressure on the push button 1.

The terms "long duration" and "short duration" are defined with respect to the time lapse $\tau$. The actuation time $t$ is considered as short if:

$$t < \tau$$

and it is considered as long if:

$$t > \tau$$

FIGS. 2 and 3 also illustrate the return-to-zero impulse of the device. This can be furnished in different manners in accordance with the use to which the device will be put. The timing circuit 8 is set at the same time as monostable circuit 4, whereby the delay time T of timing circuit 8 is longer than that of monostable circuit 4. In this case, the duration of the operation or of the chosen function will last $T - \tau$.

One could replace the monostable circuits 4 and 8 by a delay counter-actuated by the control signal SC and fed by a train of impulses derived from the watch circuit.

One can envisage multiple applications of this device, however, we will call attention to only a few by way of example.

In watches having liquid crystal displays only indicating the hour and the minute during normal working one could actuate display of either the dates (short manipulation) or the seconds (long manipulation). If the watch has a display having light-emitting diodes, such a display is not permanent, for reasons of power consumation and if the display only comprises four digits with which one can only have two pieces of information (hour and minute or date and second) the choice could be made with the aid of the duration of manipulation of a single push button. If there is provided, in a watch, besides it absolute time indicating circuit, normally and permanently displayed, another circuit, for example a chronographic circuit or a calculating circuit, these circuits can be operated in two different manners. One can choose the type of operation that the annexed circuit is going to effect by an application of adequate time on a single push buttom. In that case, the return-to-zero impulse of the device in accordance with the invention will only be given at the moment when the user decides to return to normal operation, that is to say by another push button or another appropriate means.

We claim:

1. A control device for electronic watches, comprising a push button switch for providing a control signal, delay means and first and second flip-flop circuits, inputs of each of said flip-flop circuits being connected to said push button switch by said delay means and by non-delayed circuit means, said control signal being applied to said inputs with and without delay respectively, one output of each of said flip-flop circuits being an output of said control device, and resetting means for said first and second flip-flop circuits adapted to reset said flip-flop circuits into complementary initial conditions, different combinations of output information being thus obtained at the outputs of said flip-flop circuits and of the control device respectively at the end of a delay time according to the duration of actuation of said push button switch.

2. A control device in accordance with claim 1, in which the delay means is a monostable circuit.

3. A control device in accordance with claim 1, in which the delay means is a counter actuated by the control signal and fed by signals derived from a watch circuit.

4. A control device in accordance with claim 1, in which a resetting signal of the device is given by means external to the device.

5. A control device according to claim 1, wherein said flip-flop circuits are D-flip-flops, said delay means being connected between said push button switch and the control inputs of each of said D-flip-flops while the data inputs of said D-flip-flops are controlled from the push button switch without delay, common control for the resetting inputs of both flip-flops being provided.

6. A control device according to claim 1, wherein the Q output of said first flip-flop circuit and the Q output of said second flip-flop circuit are outputs of the control device.

7. A control device according to claim 1, wherein the data inputs of said flip-flop circuits are connected to said push button switch through a common inverter and the control inputs of said flip-flop circuits are connected to said push button switch through said delay means and an inverter, said push button switch changing said control signal from "1" to "0" when actuated and one of said flip-flop circuits being reset to "0" while the other flip-flop circuit is reset to "1".

8. A control device in accordance with claim 1, in which a second delay means is provided for resetting of the device.

9. A control device in accordance with claim 8, in which the said second delay means is a monostable circuit.

10. A control device in accordance with claim 8, in which the said second delay means is a counter actuated by the control signal and fed by signals derived from a watch circuit.

11. A control device for electronic watches, comprising a switch for providing input signals at an input terminal, delay means connected to said input terminal, two flip-flop circuits having each two inputs connected to and controllable from said input terminal by said input signals through said delay means with a delay and through non-delayed means without delay respectively, an output of each of said flip-flop circuits being an output terminal of the control device, and resetting means for said flip-flop circuits, operable after the lapse of the delay time of said delay means for common resetting of said flip-flop circuits into predetermined initial conditions, such initial conditions corresponding to an initial combination of information at said output terminals, combinations of output information differing from each other and differing from said initial combination of information being thus obtained at the output terminals between the end of said delay time of said delay means and resetting of said flip-flop circuits according to whether the duration of actuation of said push button switch is shorter or longer than said delay time.

* * * * *